US006604509B1

(12) United States Patent
Hegner

(10) Patent No.: US 6,604,509 B1
(45) Date of Patent: Aug. 12, 2003

(54) FUEL INJECTION SYSTEM FOR AN INTERNAL COMBUSTION ENGINE

(75) Inventor: Ronald Hegner, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 10/019,959

(22) PCT Filed: Jul. 5, 2000

(86) PCT No.: PCT/EP00/06283

§ 371 (c)(1),
(2), (4) Date: May 20, 2002

(87) PCT Pub. No.: WO01/04488

PCT Pub. Date: Jan. 18, 2001

(30) Foreign Application Priority Data

Jul. 7, 1999 (DE) ..... 199 31 282

(51) Int. Cl.[7] ..... F02M 55/02
(52) U.S. Cl. ..... 123/456; 123/468
(58) Field of Search ..... 123/456, 468, 123/469, 514; 285/12–13, 404

(56) References Cited

U.S. PATENT DOCUMENTS 4,955,409 A * 9/1990 Tokuda et al. ..... 123/456
5,076,242 A * 12/1991 Parker ..... 123/468
5,239,964 A 8/1993 Diener et al.
5,333,587 A * 8/1994 Disilvestro et al. ..... 123/456
5,611,373 A 3/1997 Ashcraft
6,499,466 B2 * 12/2002 Lee ..... 123/456

FOREIGN PATENT DOCUMENTS

| | | |
|---|---|---|
| DE | 462273 | 6/1928 |
| EP | 0786593 | 7/1997 |
| FR | 2373212 | 11/1977 |
| FR | 2379235 | 1/1978 |

* cited by examiner

*Primary Examiner*—Thomas N. Moulis
(74) *Attorney, Agent, or Firm*—Crowell & Moring LLP

(57) ABSTRACT

The invention relates to a fuel injection system for an internal combustion engine. The inventive fuel injection system comprises a high-pressure pump (1) for delivering the fuel from a fuel reservoir (2) and a number of fuel injectors (5) for injecting the fuel into the combustion chamber of the internal combustion engine. The system is further provided with a high-pressure fuel line (4) that links the high-pressure pump (1) with the fuel injectors (5) and that contains a high-pressure reservoir (3). A fuel return line (11) returns the fuel that was not injected by the fuel injectors (5) and a leakage line (12) returns the leakage amounts that occur at the fuel injectors (5). According to the invention the high-pressure fuel line (4), the fuel return line (11) and the leakage line (12) are combined in a common fuel line (13) which is characterized by cross-sections of flow that are separated from one another by walls and that correspond to the individual lines (4, 11, 12).

19 Claims, 4 Drawing Sheets

15
16
17
5
10
36
35
27
34
26
33
19a
24
19
21
20
21a
20a
25
23
18
22
7

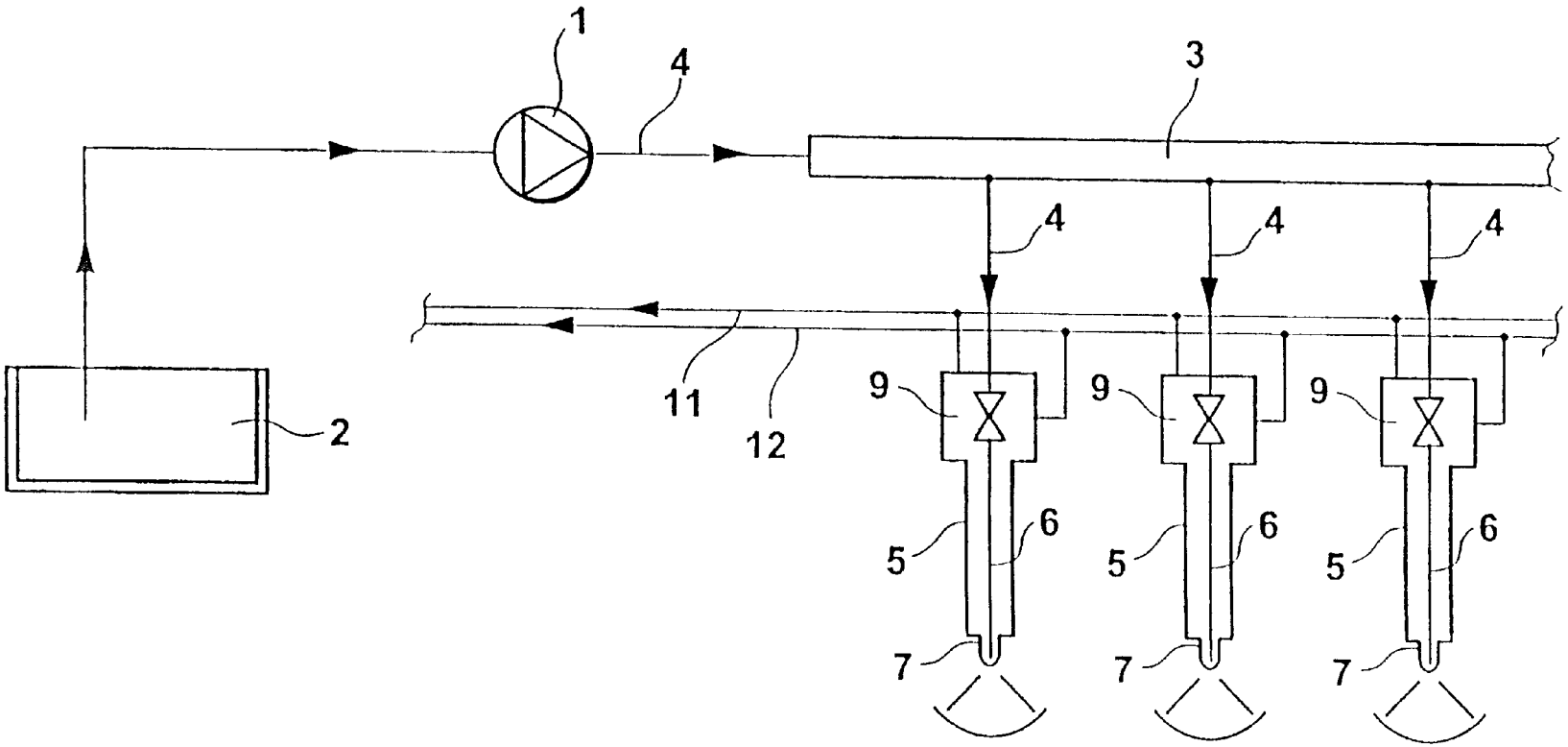
Fig. 4 Stand der Technik

FUEL INJECTION SYSTEM FOR AN INTERNAL COMBUSTION ENGINE

BACKGROUND AND SUMMARY OF THE INVENTION

The invention relates to a fuel injection system for an internal combustion engine.

Fuel injection systems for internal combustion engines, particularly diesel engines, are becoming increasingly widespread. The fuel injection systems contain a high-pressure pump for delivering the fuel from a fuel reservoir, a number of fuel injectors for injecting the fuel into the combustion space of the internal combustion engine, and a high-pressure fuel line. The high-pressure fuel line connects the high-pressure pump with the fuel injectors and contains a high-pressure reservoir for holding the fuel to be injected which is delivered by the high-pressure pump at a high pressure (common rail systems). An important advantage of such fuel injection systems is that, with respect to the injection start, the injection duration and the mass flow rate of the injected fuel per time unit, the injection operation can be very precisely adapted to the respective rotational speed condition and load condition of the internal combustion engine. In addition to the high-pressure fuel line which delivers the fuel from the high-pressure pump to the fuel injectors and holds the fuel at a high pressure, in the case of these fuel injection systems, a fuel return flow line as well as a leakage line for returning the occurring leakage quantities, which occur at the fuel injectors or because of leakiness of the sealing points, are provided. The provision of these additional fuel lines is already connected with high expenditures and, particularly in the case of large-volume diesel engines, significant vibration-related problems in connection to the mounting of the lines at the engine.

It is an object of the present invention to provide a fuel injection system of the above-mentioned type which is improved with respect to the guidance of these fuel lines.

In accordance with one aspect of the invention, a fuel injection system for an internal combustion engine includes a high-pressure pump for delivering the fuel from a fuel reservoir, a number of fuel injectors for injecting the fuel into the combustion space of the internal combustion engine and a high-pressure fuel line. The high-pressure fuel line connects the high-pressure pump with the fuel injectors and contains a high-pressure reservoir for holding the fuel to be injected which is delivered at a high pressure by the high-pressure pump. Furthermore, a fuel return flow line for returning non-injected fuel and a leakage line are provided. According to the invention, the high-pressure fuel line, the fuel return flow line and the leakage line are combined in a common fuel line with respective flow cross-sections for each of the lines, which flow cross-sections are separated by walls.

A significant advantage of the fuel system according to the invention is the fact that fastening parts, sealing and connecting elements required for the separate mounting of the fuel return flow line and of the leakage line are eliminated. This avoids the risk of a functional failure of such elements, and no difficulties occur with respect to vibration problems of such lines.

In a preferred embodiment of the fuel injection system according to the invention, the common fuel line is formed by three coaxially arranged, mutually surrounding line pipes. The interior pipe is the high-pressure fuel line, and it is surrounded by inner and outer jacket pipes which each enclose a flow cross-section and form the fuel return line and the leakage line. This results in the advantage that the high-pressure fuel line which, because of the required high-pressure stability, has a very massive construction, forms a stable support for the surrounding jacket pipes, thereby neutralizing the vibration problems.

According to a preferred embodiment, the jacket pipes surrounding the high-pressure fuel line are provided with ducts on their interior surface, which ducts extend in the longitudinal direction and form the flow cross-sections of the fuel return line and of the leakage line respectively.

In this case, the jacket pipes surrounding the high-pressure fuel line preferably have webs on their inner surface between the ducts forming the flow cross-sections of the fuel return line and the leakage line respectively. The webs rest against the outer circumference of the respective inner line surrounded by the respective jacket pipe.

According to a preferred embodiment of the invention, the inner jacket pipe surrounding the high-pressure fuel line forms the leakage line, and the outer jacket pipe surrounding the inner jacket pipe forms the fuel return line.

According to a preferred embodiment of the invention, the fuel injectors of the injection system each have a common high-pressure connection provided with a high-pressure duct mouth for the connection of the high-pressure fuel line, a leakage duct mouth for the connection of the leakage line, and a return flow duct mouth for the connection of the fuel return flow line. This results in the advantage that the high-pressure fuel line, the leakage line and the fuel return flow line are all connected to a joint connection directly on the fuel injector, so that no ducts for removing return flow or leakage amounts from the fuel injector have to be provided in the cylinder head of the internal combustion engine.

A particularly preferred embodiment of the invention provides that the joint high-pressure connection has on its face a centrally arranged high-pressure duct mouth for the connection of the high-pressure fuel line and has on its circumference, spaced away from one another in the axial direction, the leakage duct mouth for the connection of the leakage line and the return flow duct mouth for the connection of the return flow line. The individual mouths each are sealed off by sealing elements and separated from the other mouths.

According to a further development, the sealing element of the high-pressure duct mouth is formed from a conical seal interacting with a sealing cone constructed at the end of the high-pressure fuel line. The sealing elements sealing off the leakage duct mouth and the return flow duct mouth are formed from O-rings which interact with the inner circumferential surface of a screw-over sleeve having flow cross-sections which are assigned to the leakage line and the fuel return flow line and are spaced away from one another in the axial direction.

In the following, an embodiment of the invention will be explained by means of the drawing.

BRIEF DESCRIPTION OF THE DRAWINGS

FIG. 4 is a schematic block diagram of a fuel injection system for an internal combustion engine with a high-pressure reservoir according to the prior art.

DETAILED DESCRIPTION OF THE DRAWINGS

Figure 1:
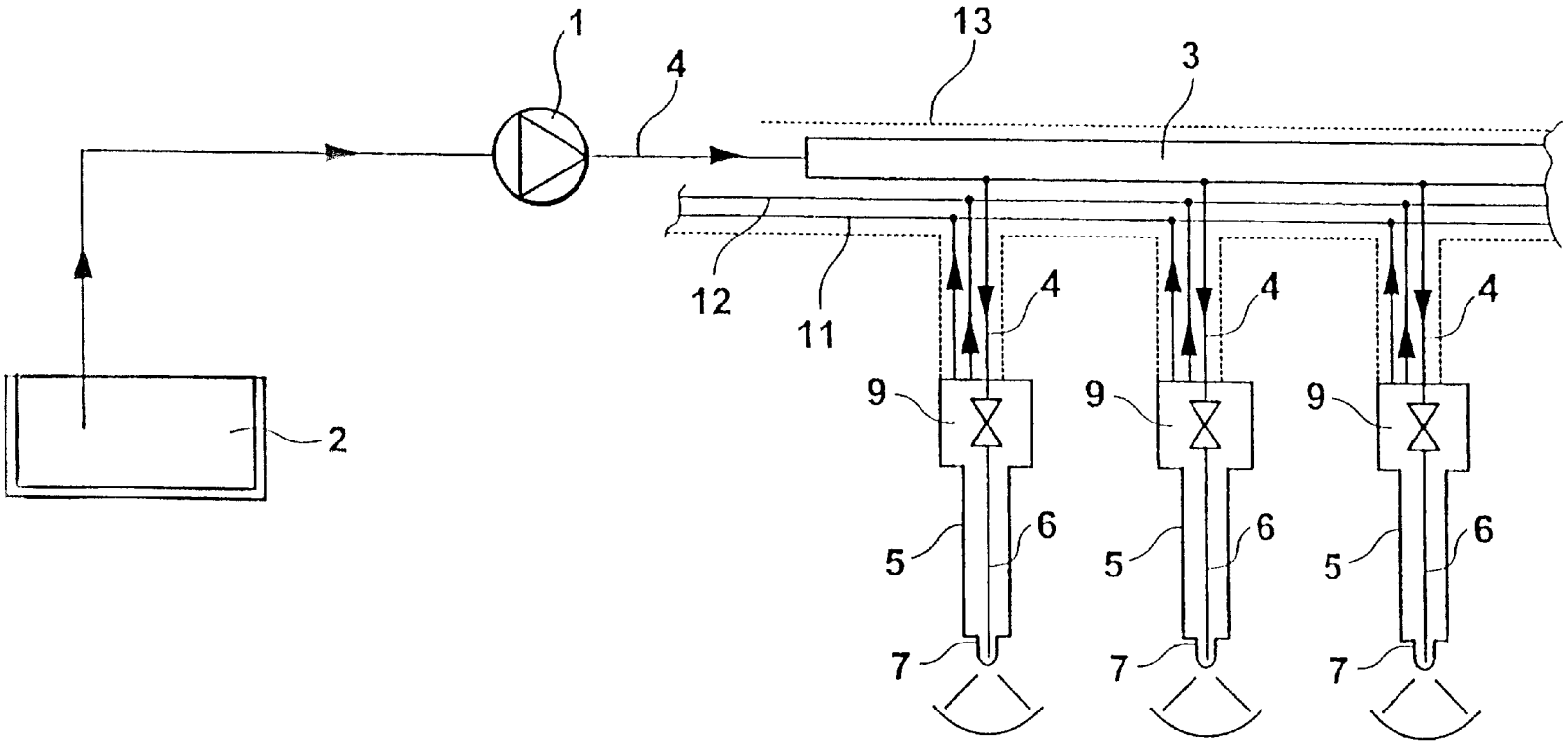
FIG. 1 is a schematic block diagram of a fuel injection system for an internal combustion engine according to an embodiment of the invention.

FIG. 4 first describes a fuel injection system for an internal combustion engine having a high-pressure reservoir to which fuel is admitted by a high-pressure pump (common rail system). Such a fuel injection system, which is used particularly for a large-volume diesel engine, contains a high-pressure pump 1 which delivers fuel from a fuel reservoir 2 to a high-pressure reservoir 3. The high-pressure reservoir 3 is contained in a high-pressure fuel line 4 connecting the high-pressure pump 1 with fuel injectors 5 and operates in the manner of an oil-elastic high-pressure reservoir. The fuel injectors 5 are provided for injecting fuel into the combustion space of the internal combustion engine during an injection operation defined precisely according to the injection start, the injection end and the course of the injection. The fuel injectors 5 are controlled by a control unit not illustrated in the figure as a function of the operating condition of the internal combustion engine, particularly the rotational speed, the load, the temperature and other parameters. Each fuel injector 5 contains an injection nozzle 7 to which the fuel, which is to be injected, is admitted by way of a fuel duct 6 provided in the fuel injectors 5. The control of the fuel injector 5 takes place by way of a control valve 9 which is constructed as a 3/2-way valve known per se in the prior art or as a 2/2-way servo valve. For returning fuel, which was delivered by way of the high-pressure fuel line 4 but was not injected by the fuel injectors 5, in the form, for example, of control quantities, a fuel return flow line 11 is provided which is in each case connected to a corresponding connection of each of the fuel injectors 5. Furthermore, a leakage line 12 is connected with each fuel injector 5, which leakage line 12 is used for returning leakage quantities, as, for example, in the event of a line break and dysfunctional high-pressure sealing points. In the case of a conventional fuel injection system, as illustrated in FIG. 4, the fuel return flow line 11 and the leakage line 12 are each provided as independent lines.

FIG. 1 is a schematic block diagram of a fuel injection system having a high-pressure reservoir acted upon by a high-pressure pump (common-rail system) according to an embodiment of the present invention. As in the conventional fuel injection system described in FIG. 4, a high-pressure pump 1 is provided which delivers fuel from a fuel reservoir 2 to a high-pressure reservoir 3 which operates in the manner of an oil-elastic high-pressure reservoir and is contained in a high-pressure fuel line 4 which connects the high-pressure pump 1 with fuel injectors 5 for injecting the fuel into the combustion space of the internal combustion engine. The fuel injectors 5, in turn, contain one injection nozzle 7 respectively which is acted upon by way of a fuel duct 6 by the fuel to be injected held in the high-pressure reservoir 3. The control of the injection is carried out by a control valve 9 provided in the fuel injector 5.

According to the invention, a fuel return flow line 11 for returning fuel quantities not injected by the fuel injectors 5 and a leakage line 12 for returning leakage quantities occurring at the fuel injectors 5, together with the high-pressure fuel line 4 containing the high-pressure reservoir 3, are combined in a common fuel line 13, as illustrated by the broken circumference lines in FIG. 1. In general terms, the high-pressure fuel line 4, the fuel return flow line 11 and the leakage line 12 are formed by separate flow cross-sections provided in the joint fuel line 13. The construction of the joint fuel line 13 will be described in detail in the following.

Figure 2:
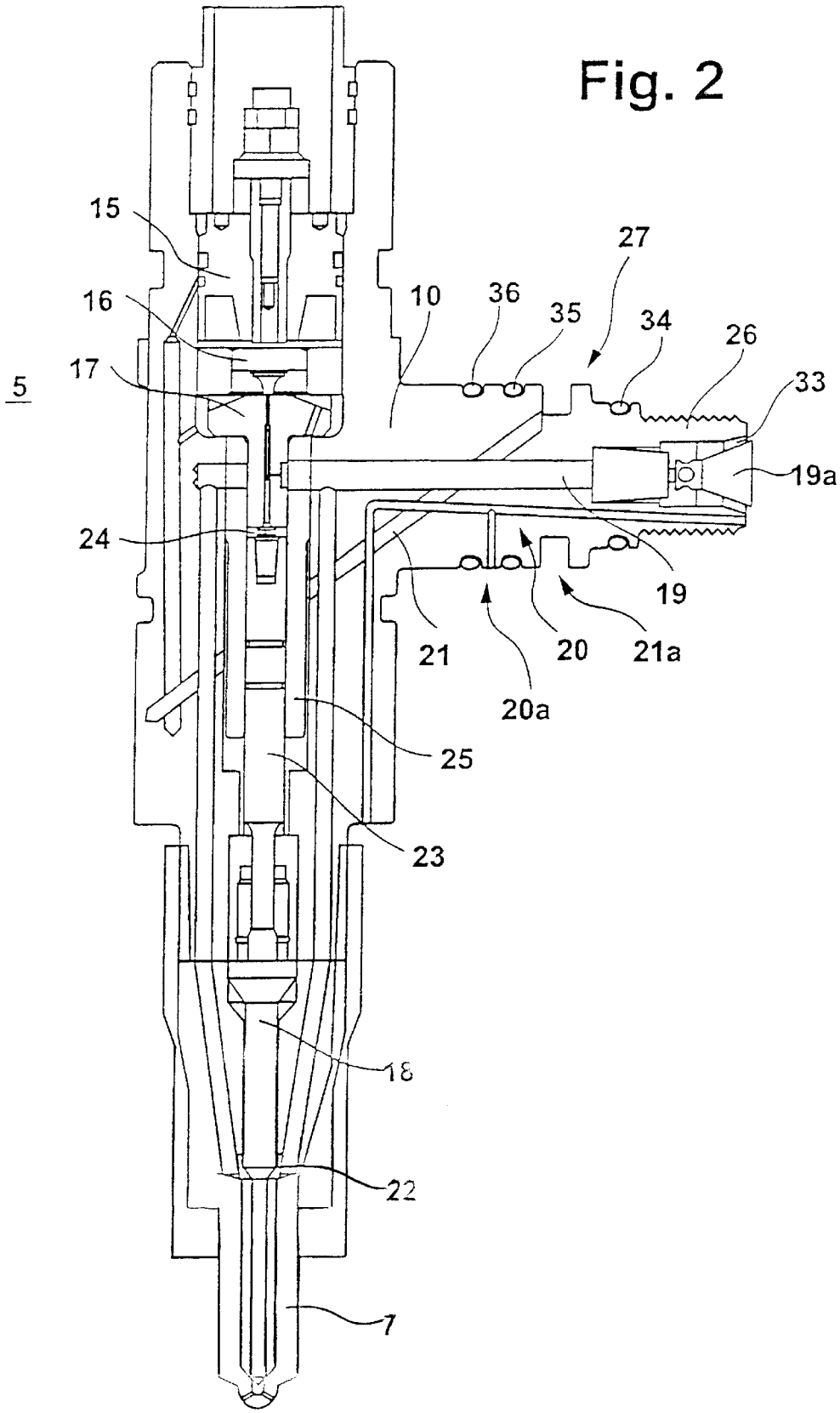
FIG. 2 is a slightly schematic longitudinal sectional view of a fuel injector as used in the described embodiment of the invention.

FIG. 2 is a slightly schematic longitudinal sectional view of a fuel injector as it is used in the described embodiment of the fuel injection system according to the invention. The fuel injector, which as a whole has the reference number 5, comprises an injector housing 10 in which a nozzle needle 18 is longitudinally displaceably disposed in a guiding sleeve 25 constructed in the injector housing 10. The tip of the nozzle needle 18 interacts with an injection nozzle 7 constructed at the lower end of the injector housing 10 to open and close an injection opening cross-section. In the injector housing 10, a high-pressure duct 19 is constructed which leads from a high-pressure connection 26 arranged laterally on the fuel injector 5 to a nozzle antechamber 22 surrounding the nozzle needle 18. By way of the high-pressure duct 19, the fuel to be injected is fed by the high-pressure fuel line 4 illustrated in FIG. 1 at a high pressure to the nozzle space 22. The control of the fuel injector 5 takes place by means of a solenoid 15 arranged at its rearward end, which solenoid 15 interacts with a control valve formed by a closing body 16 and a valve body 17. By means of the control valve 16, 17, a control space 24 is optionally acted upon by fuel supplied at a high pressure or is relieved from pressure. The control space 24 is constructed at the rear side of a needle stilt 23 acting upon the nozzle needle 18. For removing the control quantities occurring at the control valve 16, 17, a return flow duct 21 is provided. A leakage duct 20 is used for removing leakage quantities occurring in the fuel injector 5. To this extent, the construction of the fuel injector 5 illustrated in FIG. 2 corresponds to a fuel injector as currently used by the applicant.

According to the illustrated embodiment of the invention, it is provided that the high-pressure connection 26, which is used for the connection of the high-pressure fuel line 4 illustrated in FIG. 1, is constructed as a common connection which, in addition to a high-pressure duct mouth 19*a* for the connection of the high-pressure fuel line 4, has a leakage duct mouth 20*a* for the connection of the leakage line 12 illustrated in FIG. 1 and a return flow duct mouth 21*a* for the connection of the fuel return flow line 11 illustrated in FIG. 1. The high-pressure duct mouth 19*a* for the connection of the high-pressure fuel line 4 is centrally arranged on the face of the common high-pressure connection 26. The leakage duct mouth 20*a* for the connection of the leakage line 12 and the return flow duct mouth 21*a* for the connection of the return flow line 11 are provided on the circumference of the joint high-pressure connection 26. The leakage duct mouth 20*a* and return flow duct mouth 21*a* collectively provide the return flow connect 27 and are spaced away from one another in the axial direction. The above-mentioned mouths 19*a*, 20*a*, 21*a* of the high-pressure duct, the leakage duct and the return flow duct are each sealed off and separated from one another by assigned sealing elements.

The construction of the common fuel line 13 and the manner of its connection to the joint high-pressure connection 26 of the fuel injector 5 will now be explained in detail by means of FIGS. 3*a*) and *b*) on connection with FIG. 2. As illustrated in FIG. 3*b*), the common fuel line 13 (compare FIG. 1) is formed by three line pipes 30, 31, 32 which are coaxially arranged and surround one another. Of these, the inner line pipe 30 forms the high-pressure fuel line 4. The inner line pipe 30 is surrounded by an inner and an outer jacket pipe 31, 32, which each enclose a flow cross-section

31*a*, 32*a* and form the fuel line 11 and the leakage line 12 (compare FIG. 1). The inner jacket pipe 31 surrounding the high-pressure fuel line 30 forms the leakage line 12; the outer jacket pipe 32 surrounding the inner jacket pipe 31 forms the fuel return flow line 11. On their inner surface, the jacket pipes 31, 32 are provided with ducts 31*a*, 32*a* which extend in the longitudinal direction and which each form the flow cross-sections for the fuel return line 11 and the leakage line 12. Between these ducts 31*a*, 32*a* forming the flow cross-sections, webs 31*b*, 32*b* are constructed which rest against the outer circumference of the respective interior pipe surrounded by the corresponding jacket pipe 31, 32. Thus, the webs 31*b* of the inner jacket pipe 31 rest against the outer circumference of the high-pressure pipe 30, and the webs 32*b* of the outer jacket pipe 32 rest against the outer circumference of the inner jacket pipe 31.

Figure 3A:
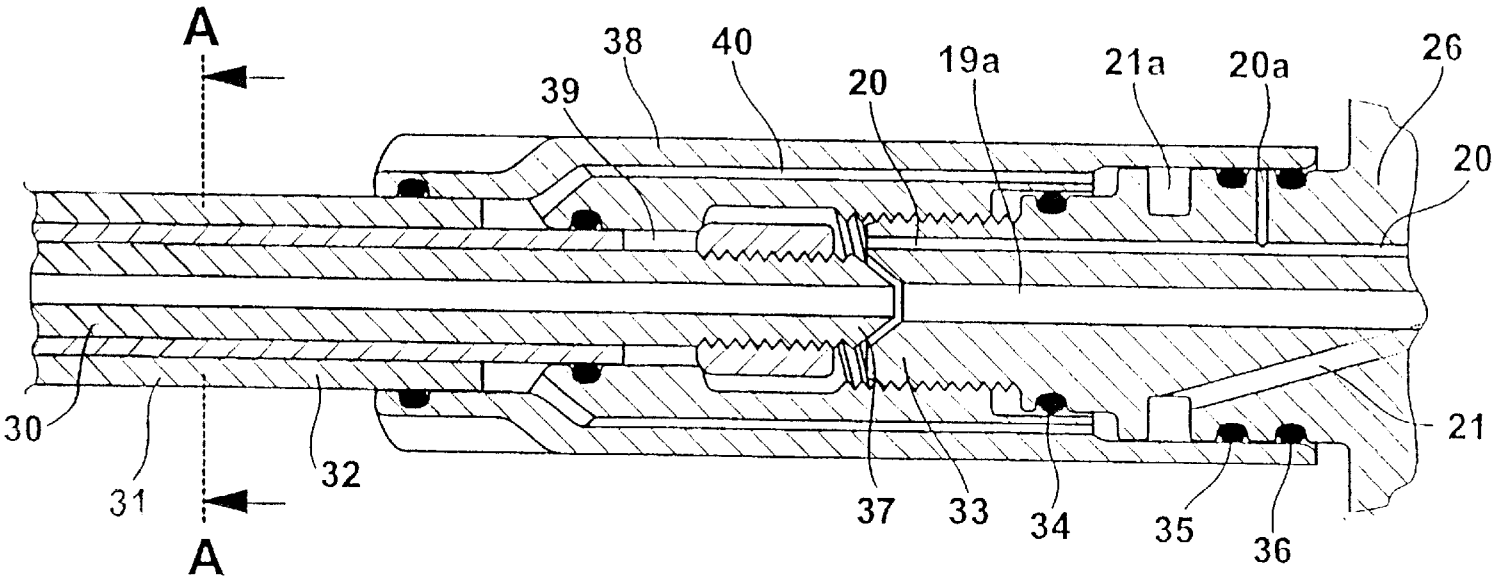
FIG. 3 is a cross-sectional view of the connection of a common fuel line, which combines the high-pressure fuel line, the fuel return flow line and the leakage line, to a fuel injector in the described embodiment.
Figure 3B:
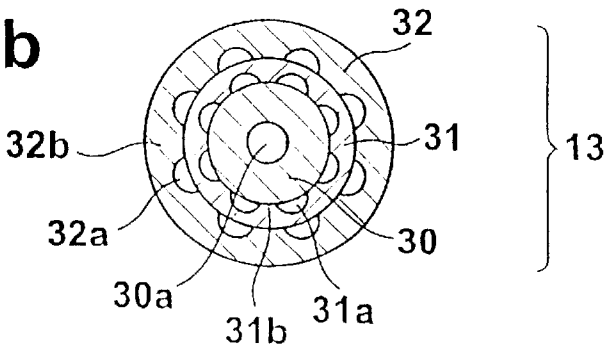

As illustrated in FIG. 3*a*), a connecting element, as a whole, marked with the reference number 28, is provided on the injector-side end of the common fuel line formed by the three pipes 30, 31, 32, which connecting element establishes a connection between the flow cross-sections 30*a* of the high-pressure pipe 30, 31*a* of the inner jacket pipe 31 forming the leakage line 12, and 32*a* of the outer jacket pipe 32 forming the fuel return line with the assigned mouths 19*a*, 20*a* and 21*a* respectively of the high-pressure duct, the leakage duct and the return flow duct constructed on the common high-pressure connection 26. As illustrated, a sealing cone 37 is constructed at the end of the central high-pressure pipe 30. The sealing cone 37 interacts with a sealing element in the form of a sealing cone 37 constructed on the face of the common high-pressure connection 26, as customary per se in the field of fuel injectors. The mouths 21*a* of the return flow duct 21 and 20*a* of the leakage duct 20 constructed on the circumference of the common high-pressure connection 26 are each sealed off and separated from one another by respective sealing elements 34, 35, 36 in the form of O-rings. A screw-over sleeve 38, which is a significant part of the connecting element 28, contains inner and outer connection ducts 39 and 40. The inner connection duct 39 establishes a connection with the flow cross-section 31*a* of the inner jacket pipe 31, and the outer connection duct 40 establishes a connection with the flow cross-section 32*a* of the outer jacket pipe 32. The connection ducts 39 and 40 each open out in the proximity of the mouths 20*a* and 21*a* of the leakage duct and the return flow duct. The sealing elements 33, 34, 35 interact with the inner circumferential surface of the screw-over sleeve 38 such that a flow path is created from the connection duct 40 to the return flow duct mouth 21*a*, and a flow path is created from the connection duct 39 to the leakage duct mouth 20*a*.

What is claimed is:

1. A fuel injection system for an internal-combustion engine, comprising:

a high-pressure pump for delivering fuel from a fuel reservoir;

fuel injectors for injecting the fuel into a combustion space of the internal combustion engine;

a common fuel line including:

a high-pressure fuel line having a flow cross-section and connecting the high-pressure pump with the fuel injectors, the high-pressure fuel line including:

a high-pressure reservoir for holding the fuel to be injected, a fuel return flow line for returning fuel not injected by the fuel injectors, the fuel return flow line having a flow cross-section, and a leakage line for returning fuel leakage at the fuel injectors, the leakage line having a flow cross-section and surrounding the high-pressure fuel line, wherein the flow cross-sections are separated from one another by walls; and a connection element for connecting the common fuel line with the fuel injectors, the connection element having a screw-over sleeve, an inner connection duct and an outer connection duct.

2. The fuel injection system according to claim 1, wherein the fuel return line and leakage line surround the high-pressure fuel line, each of the fuel return and leakage lines including ducts on its interior surface, the ducts extending in the longitudinal direction and forming the flow cross-section of the line.

3. The fuel injection system according to claim 2, wherein each of the fuel return and leakage lines includes webs on its inner surface between the ducts, and the webs resting against the outer circumference of the inner line surrounded by the line.

4. fuel injection system according to claim 3, wherein the leakage line surrounds the high-pressure fuel line and the fuel return line surrounds the leakage line.

5. The fuel injection system according to claim 4 further comprising a common high-pressure connection that connects the fuel injectors to the high-pressure fuel line, the leakage line and the fuel return flow line, the common high-pressure connection including a high-pressure duct mouth for the connection of the high-pressure fuel line, a leakage duct mouth for the connection of the leakage line and a return flow duct mouth for the connection of the fuel return flow line.

6. The fuel injection system according to claim 3 further comprising a common high-pressure connection that connects the fuel injectors to the high-pressure fuel line, the leakage line and the fuel return flow line, the common high-pressure connection including a high-pressure duct mouth for the connection of the high-pressure fuel line, a leakage duct mouth for the connection of the leakage line and a return flow duct mouth for the connection of the fuel return flow line.

7. The fuel injection system according claim 6, wherein the common high-pressure connection has on its face a centrally arranged high-pressure duct mouth for the connection of the high-pressure fuel line and has on its circumference the leakage duct mouth for the connection of the leakage line and the return flow duct mouth for the connection of the return flow line, the leakage duct mouth and return flow duct mouth being spaced apart in the axial direction, wherein each mouth is sealed off by a sealing element and is separated from the other mouths.

8. The fuel injection system according to claim 2, wherein the leakage line surrounds the high-pressure fuel line and the fuel return line surrounds the leakage line.

9. The fuel injection system according to claim 8 further comprising a common high-pressure connection that connects the fuel injectors to the high-pressure fuel line, the leakage line and the fuel return flow line, the common high-pressure connection including a high-pressure duct mouth for the connection of the high-pressure fuel line, a leakage duct mouth for the connection of the leakage line and a return flow duct mouth for the connection of the fuel return flow line.

10. The fuel injection system according to claim 2 further comprising a common high-pressure connection that connects the fuel injectors to the high-pressure fuel line, the leakage line and the fuel return flow line, the common high-pressure connection including a high-pressure duct mouth for the connection of the high-pressure fuel line, a leakage duct mouth for the connection of the leakage line and a return flow duct mouth for the connection of the fuel return flow line.

11. The-fuel injection system according claim 10, wherein the common high-pressure connection has on its face a centrally arranged high-pressure duct mouth for the connection of the high-pressure fuel line and has on its circumference the leakage duct mouth for the connection of the leakage line and the return flow duct mouth for the connection of the return flow line, the leakage duct mouth and return flow duct mouth being spaced apart in the axial direction, wherein each mouth is sealed off by a sealing element and is separated from the other mouths.

12. The fuel injection system according to claim 1, wherein the leakage line surrounds the high-pressure fuel line and the fuel return line surrounds the leakage line.

13. The fuel injection system according to claim 12 further comprising a common high-pressure connection that connects the fuel injectors to the high-pressure fuel line, the leakage line and the fuel return flow line, the common high-pressure connection including a high-pressure duct mouth for the connection of the high-pressure fuel line, a leakage duct mouth for the connection of the leakage line and a return flow duct mouth for the connection of the fuel return flow line.

14. The fuel injection system according claim 13, wherein the common high-pressure connection has on its face a centrally arranged high-pressure duct mouth for the connection of the high-pressure fuel line and has on its circumference the leakage duct mouth for the connection of the leakage line and the return flow duct mouth for the connection of the return flow line, the leakage duct mouth and return flow duct mouth being spaced apart in the axial direction, wherein each mouth is sealed off by a sealing element and is separated from the other mouths.

15. The fuel injection system according to claim 1 further comprising a common high-pressure connection that connects the fuel injectors to the high-pressure fuel line, the leakage line and the fuel return flow line, the common high-pressure connection including a high-pressure duct mouth for the connection of the high-pressure fuel line, a leakage duct mouth for the connection of the leakage line and a return flow duct mouth for the connection of the fuel return flow line.

16. The fuel injection system according claim 15, wherein the common high-pressure connection has on its face a centrally arranged high-pressure duct mouth for the connection of the high-pressure fuel line and has on its circumference the leakage duct mouth for the connection of the leakage line and the return flow duct mouth for the connection of the return flow line, the leakage duct mouth and return flow duct mouth being spaced apart in the axial direction, wherein each mouth is sealed off by a sealing element and is separated from the other mouths.

17. The fuel injection system according to claim 16, wherein the sealing element of the high-pressure duct mouth includes a conical seal interacting with a sealing cone at the end of the high-pressure fuel line, and the sealing elements sealing off the leakage duct mouth and the return flow mouth each includes an O-ring which interacts with an inner circumference surface of the screw-over sleeve, the screw-over sleeve having flow cross-sections assigned to the leakage line and the fuel return flow line and spaced from one another in the axial direction.

18. The fuel injection system according to claim 1, wherein the inner connection duct establishes a connection with the flow cross-section of the leakage line and the leakage duct mouth of the fuel injector.

19. The fuel injection system according to claim 1, wherein the outer connection duct establishes a connection with the flow cross-section of the return flow line and the return flow duct mouth of the fuel injector.

* * * * *